United States Patent [19]

Bartholomew

[11] Patent Number: 5,027,972

[45] Date of Patent: Jul. 2, 1991

[54] CONTAINER, ESPECIALLY FOR FOODSTUFFS

[76] Inventor: Robert B. Bartholomew, 4160 Louisiana Avenue, Unit G,, San Diego, Calif. 92104

[21] Appl. No.: 577,207

[22] Filed: Sep. 4, 1990

[51] Int. Cl.[5] ..... B65D 21/02

[52] U.S. Cl. ..... 220/526; 220/528

[58] Field of Search ..... 220/526, 528

[56] References Cited

U.S. PATENT DOCUMENTS

| | | | |
|---|---|---|---|
| 2,496,296 | 2/1950 | Lobl | 206/545 |
| 2,731,996 | 1/1956 | Hayes | 220/528 |
| 2,859,786 | 11/1958 | Tupper | 150/5 |
| 3,275,329 | 9/1966 | Lieberman et al. | 220/528 |
| 3,487,972 | 1/1970 | Swett | 220/526 |
| 3,679,088 | 7/1972 | Swett et al. | 220/42 R |
| 3,679,089 | 7/1972 | Swett et al. | 220/42 C |
| 3,732,955 | 5/1973 | Carter et al. | 190/51 |
| 3,747,751 | 7/1973 | Miller et al. | 220/528 |
| 3,751,845 | 8/1973 | Van Leeuwen | 43/56 |
| 3,842,975 | 10/1974 | Chang | 206/72 |
| 3,859,819 | 1/1975 | Kaplan | 62/371 |
| 4,106,597 | 8/1978 | Shook et al. | 190/42 |
| 4,143,165 | 3/1979 | Daswick | 426/113 |
| 4,202,465 | 5/1980 | McLean | 220/468 |
| 4,286,644 | 9/1981 | Taylor | 62/457 |
| 4,471,880 | 9/1984 | Taylor et al. | 220/306 |
| 4,807,776 | 2/1989 | Cortopassi | 220/528 |
| 4,844,330 | 7/1989 | Roosa, et al. | 229/120.06 |
| 4,955,503 | 9/1990 | Prodes | 220/526 |

*Primary Examiner*—Joseph M. Moy

*Attorney, Agent, or Firm*—Brown, Martin, Haller & McClain

[57] ABSTRACT

A resealable compartmented container for foodstuffs and the like is disclosed, which permits full sealing of all compartments individually, which prevents mixing of or contact between different stored items. The container has an open-topped base, a tray having a plurality of open-topped compartments therein, and a cover; the peripheral sides of the tray engagable with the top of the sides of the base to support the tray, the walls of the compartments and the peripheral sides of the tray forming a grid-like pattern; and the cover having recesses in a mirror-image of the grid-like pattern of the tray and sealable with the top edges of the compartments and the sides throughout the grip-like pattern to form a substantially air-tight releasable seal with each compartment. The containers may be used for a variety of purposes, including as a kit for sandwich making, the storage of various types of meal components, the storage of different courses of a meal, segregation of different items where contact between various items could harm or destroy some of the items, or where mixture of the materials could be harmful to the user, as with storage of different types of medications.

13 Claims, 2 Drawing Sheets

CONTAINER, ESPECIALLY FOR FOODSTUFFS

BACKGROUND OF THE INVENTION

1. Field of the Invention

The invention herein relates to containers, especially those used for foodstuffs. More particularly, it relates to such containers which have resealable covers.

2. Description of the Prior Art

There have been a variety of small containers on the market for many years. Of particular relevance to the present invention are those containers, primarily intended for food storage, which are usually made of plastic and are sold under trade names such as "Tupperware." Such containers normally have a lid which covers the top of the open container and can be releasably sealed around the peripheral edge of the container, such that outside air is excluded from the container, and odors which may be generated by the foodstuffs within the container (for instance, onions) are sealed within the container.

These peripherally sealed containers, however, do not have the capability of preventing movement and mixture of the various foodstuffs within the container or of preventing the odors from one type of food from being absorbed by the other foods within the container. Consequently, one finds that such containers are normally used each for a single food item. If a person wishes to have several food items available (for instance, ingredients for making sandwiches), he or she must have several separate sealed containers, each for a single food item. Such is of course inconvenient, requires additional expense for purchase of the extra containers, may not be practical when one has only limited storage and transportation space available and is subject to having some of the separate containers misplaced.

There have also been a variety of containers available in the marketplace which have a number of compartments within the container. Fishing tackle boxes, sewing boxes and tool boxes often have several wells or compartments, each open at the top for containing a variety of small items, such as fishing flies, sewing notions or small tools and fasteners. Such compartmented containers commonly are designed such that when the container is closed, the lid (or another layer or tier of compartments) closely overlies the open tops of the individual wells or compartments, so that the various items in the separate wells or compartments cannot easily be moved or displaced from one compartment to another. However, since these containers are designed merely to keep the various items from being mixed when the container is moved, such covers or lids do not actually seal the various compartments. In fact, most such containers are specifically designed only to loosely cover each compartment, so that the fisherman, seamstress or mechanic can readily retrieve the particular item desired.

It would therefore be advantageous to have a container which would permit a person to store a variety of different items such as foodstuffs with each item being fully segregated and sealed apart from the others, such that there would be no intermixing of the items themselves, their liquids or their aromas. It would also be advantageous to have such a container being lightweight, compact, easily portable and sufficiently rugged that it could be used by different types of people in a wide variety of environments, including use at home, on the job or during outdoor activities.

SUMMARY OF THE INVENTION

The invention herein is a resealable compartmented container for foodstuffs and the like comprising an open-topped base having a bottom and sides, the base having an open interior volume; a tray having a plurality of open-topped compartments therein, each compartment having a bottom and sides and having an open interior volume, the tray also having peripheral sides; and a cover; the peripheral sides of the tray including support means engagable with the top of the sides of the base to support the tray in a position overlying the open top of the base; the walls of the compartments and the peripheral sides of the tray being aligned and forming a grid-like pattern; and the cover including releasable closure means directed downwardly therefrom, forming a mirror-image of the grid-like pattern of the tray and being sealably engagable with the top edges of the walls and the sides throughout the grid-like pattern to form a substantially air-tight releasable seal with each compartment when the tray is disposed overlying the base and the cover is removably secured to the tray.

The compartments may be of any suitable size and shape and may vary within a single container. The base may be used for containment of cooling means for the items stored in the tray.

Conveniently the containers will be made of some sort of plastic or polymeric material such as a semi-rigid polyethylene or polypropylene, a hard rubber or the like, or from a flexible metal.

The containers may be used for a variety of purposes, including as a kit for sandwich making, the storage of various types of meal components, or the storage of different courses of a meal. One can also use the container to segregate a wide variety of different items where contact between various items could harm or destroy some of the items, such as with segregation of dry materials from liquids, caustic or acidic materials from other materials, or where mixture of the materials could be harmful to the user, as with storage of different types of medications.

DETAILED DESCRIPTION AND PREFERRED EMBODIMENTS

Figure 1:
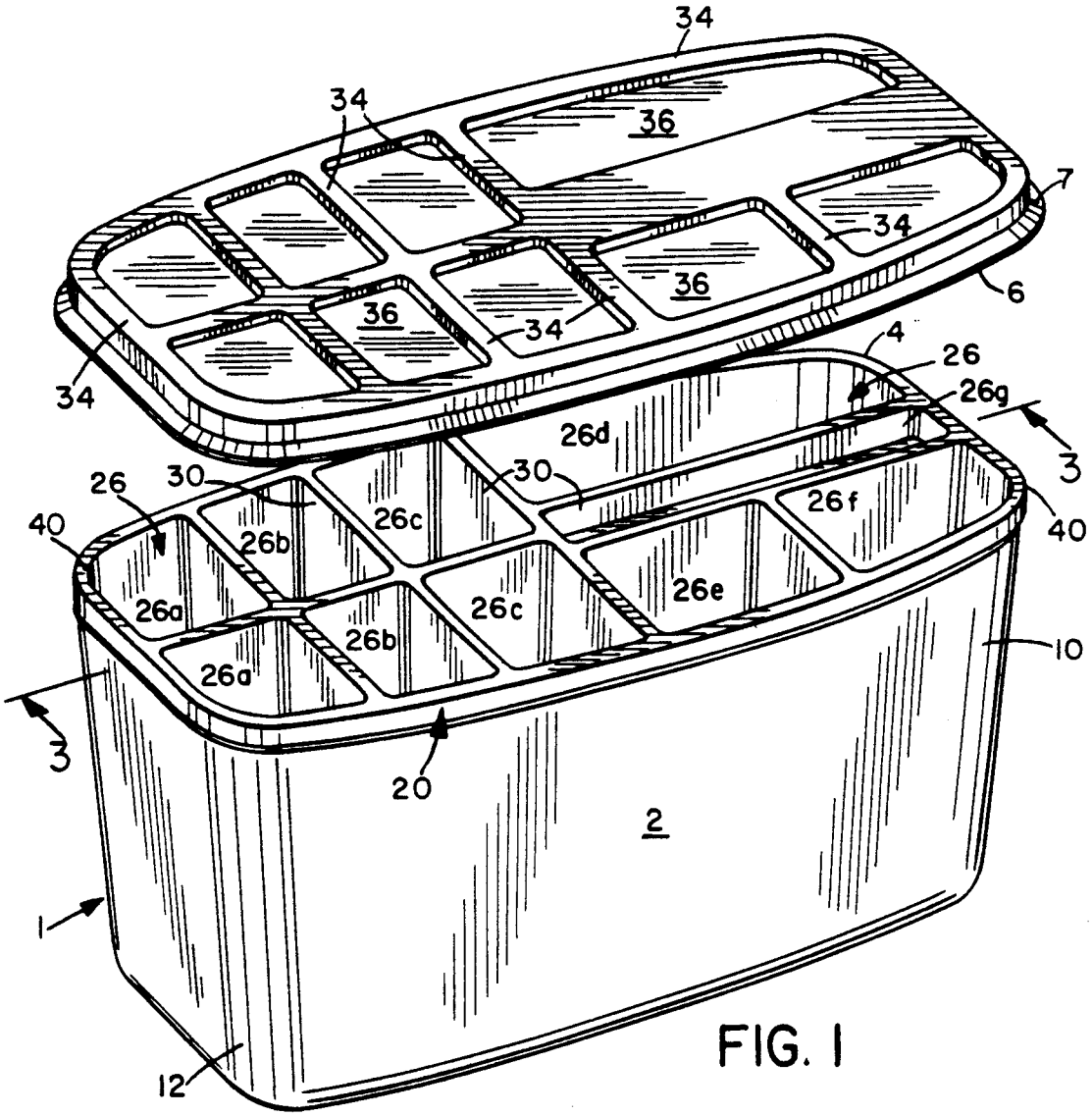
FIG. 1 is a perspective view of the container of the present invention, with the lid separated from the tray and base.

The present invention will be best understood by reference to the drawings. As will be seen in FIGS. 1 and 3, the container 1 of this invention has three principal parts, base 2, tray 4 and lid or cover 6. Base 2 is a hollow box-like unit having a bottom 8 and sides 10. In the embodiment shown the sides 10 are all a single contiguous unit with rounded corners 12 and rounded edges 14 merging with bottom 8. This is the preferred embodiment and lends itself quite readily to manufacture of the base by a number of common techniques, including plastics molding, thermoforming and the like. It is also contemplated, however, that the base could be made of separate bottom and side components which would be joined at their edges by conventional means, such as adhesive bonding.

The shape of the base 2 substantially dictates the shape of the overall container 1. In the embodiment shown in the Figures, the base 2 and the overall container 1 both have a generally rectangular but somewhat rounded appearance in each dimension. This is a very advantageous configuration, in that it is one that provides a readily manufacturable design, as well as being aesthetically pleasing. It will be understood, of course, that the particular shape of the container is a matter of choice and that containers which have different rounded, polygonal, rectangular, square or other configurations are all well within the scope of the present invention. The only limitations on shape will normally be that the shape must be such that the three components all fit properly together in the sealed relationship as will be described below and that the container at rest is stable.

The bottom 8 is preferably flat as shown but could, if desired, be ribbed, bezeled or include a series of raised protuberances. The latter might be advantageous where, for example, it is anticipated that the container may be often set on a wet surface (as for instance a boat deck), so that the inadvertent formation of a water suction seal between the flat bottom of the container and the wet surface is prevented.

The base 2 normally will have sufficient depth such that when the tray 4 is seated in position on top of the base 2, there will be a substantial empty volume between the underside of the tray 4 and the bottom 8 of the base 2. This space can be used for a variety of purposes, including the storage of large objects such as soft drink cans, or it may be fully or partially filled with a cooling medium, such as ice or the commercial packaged refreezeable liquids which are sold under trade names such as "Blue Ice." It may be advantageous to form registers (not shown) in the base 2 to accommodate soft drink cans.

Figure 3:
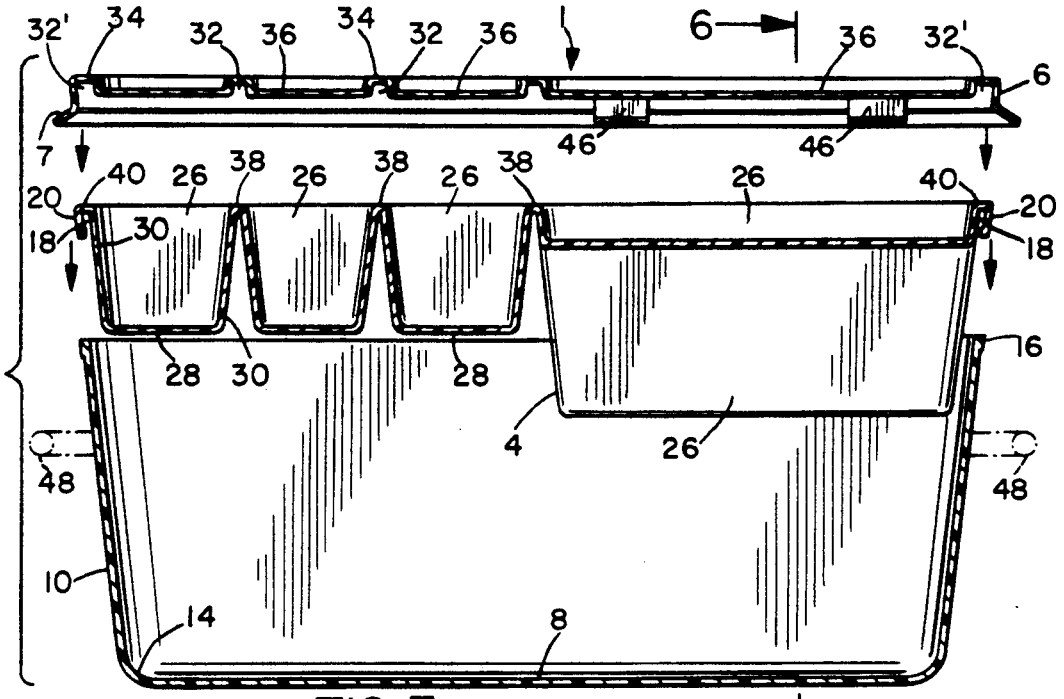
FIG. 3 is a sectional view taken on line 3—3 of FIG. 1.
Figure 4:
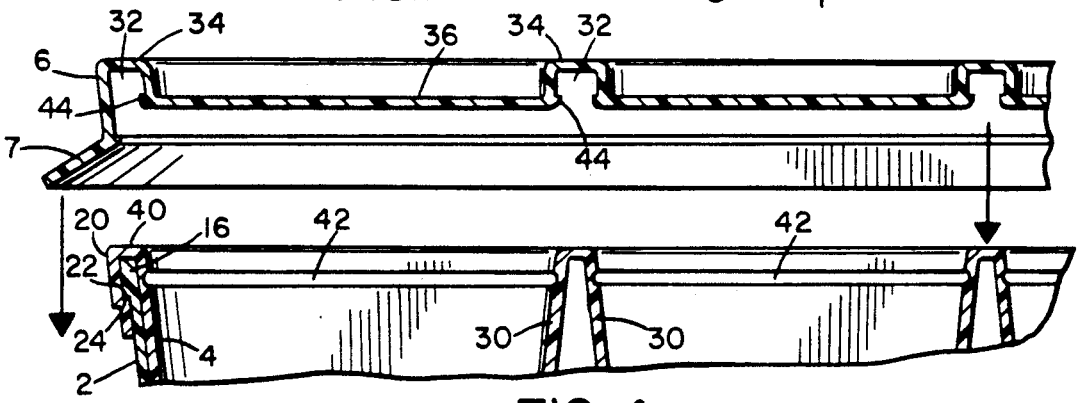
FIG. 4 is an enlargement of a portion of FIG. 3, showing details of the attachment of the lid to the tray and base.

The tray 4 is made so as to be sealably seated at its peripheral edges along the top of the base 2, as shown in FIGS. 1, 3 and 4. A typical releasable sealing arrangement is shown in cross-section in FIGS. 4, 5 and 6, where the upper edge 16 of wall 10 of base 2 fits by an interference fit into the trough 18 formed by overturned portion 20 of the top edge of tray 4. While the interference fit between the two parts will usually be adequate for sealing and securement, one can also if desired incorporate a shoulder 22 into the upper edge 16 of side 10 which interfits With a corresponding shoulder 24 in the overturned portion 20 of wall 4.

Figure 2:
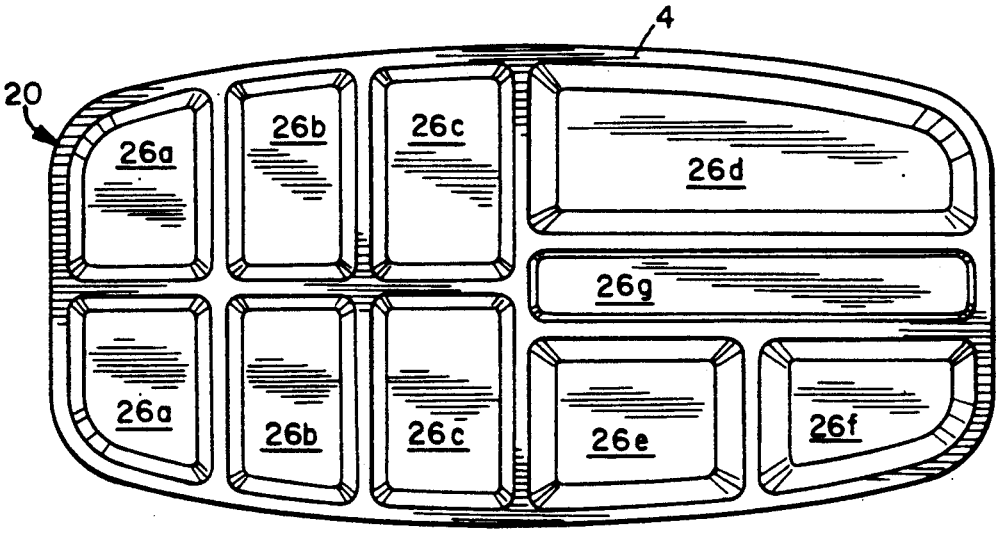
FIG. 2 is a top plan view of the tray of this container.

The tray 4 contains a plurality of wells or compartments 26; these are individually designated **26*a*–26*g* in FIGS. 1 and 2 to illustrate typical shapes of the compartments 26. It will be understood, of course, that the particular shapes and sizes shown in the appended drawings are exemplary only, and that the specific combination of sizes and shapes of the compartments will be entirely at the designers' discretion. It is contemplated that there may be a complete line of containers of the present invention, with each intended for a different market or purpose, such that there may be numerous different "standard" configurations of compartments 26 depending on the proposed use of any particular embodiment of the container 1**.

As will be evident from the Figures, the various compartments 26 can have different depths and breadths and can be squared off or rounded. It is preferred that the various compartments 26 be slightly tapered toward the bottom as shown in FIG. 3, to facilitate manufacture of the container and retrieval of foodstuffs or other items from the compartments by the user. It is also preferred that the transition between the bottom 28 and wall 30 of each compartment 26 be rounded slightly to facilitate cleaning of the tray 4 after use, particularly when the tray 4 is to be used for storing foodstuffs in compartments 26. In order to interfit or mesh properly with the cover 6 for complete sealing as defined below, the tops of the walls 30 and the top 40 of the peripheral wall of tray 4 will be essentially aligned.

The third component of the container 1 of this invention is cover or lid 6. The structure of cover 6 is critical to the functioning of the present invention. Formed in cover 6 and directed downwardly from the plane of cover 6 are recesses 32 which are formed by inverted U-shaped channels 34. The exact method of formation of recesses 32 and channels 34 is not critical. In the embodiment shown in the drawings, the channels 34 are formed by depressing the intermediate segments 36 of the cover 6. Alternatively, the top surface of cover 6 could be a relatively thin flat planar surface and the channels 34 could be formed downwardly extending from the under surface of cover 6, or the cover 6 could be of substantially greater thickness with the recesses 32 cut into the underside of the cover 6 and the channels 34 and segments 36 comprising contiguous undivided portions of the uncut thickness of the cover 6. As with the walls of the tray 4, the recesses 32 will be aligned for proper interfitting in the sealed configuration.

Each of the recesses 32 corresponds precisely with one mutual top edge 38 of two adjacent compartments 26 in tray 4 or, in the case of the peripheral recesses 32', with the top edge 40 of the overturned portion of the peripheral wall of tray 4, such that the recesses 32 and channels 34 of cover 6 and the top edges 38 and 40 of tray 4 form two corresponding mirror-image grid-like patterns. When the unit is assembled, tray 4 is secured to the top of base 2 and cover 6 is sealingly interlocked with tray 4 by means of the interfitting of recesses 32 and 32' with edges 38 and 40 as indicated in FIGS. 4 and 5, such that each compartment 26 is completely and individually sealed around its entire periphery and the contents of each compartment 26 are fully isolated from the contents of each of the other compartments.

Figure 5:
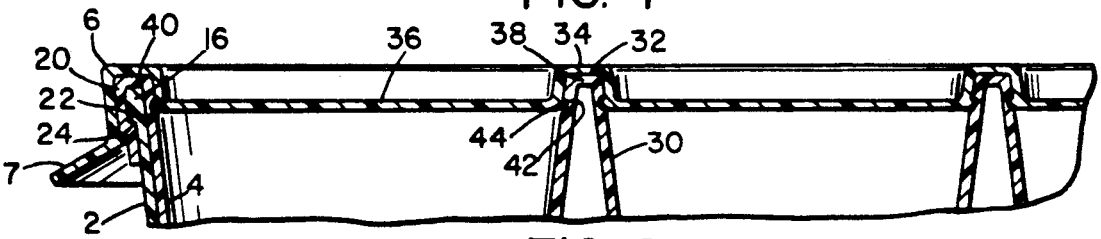
FIG. 5 is a view similar to FIG. 4, with the lid sealed in the closed position.
Figure 6:
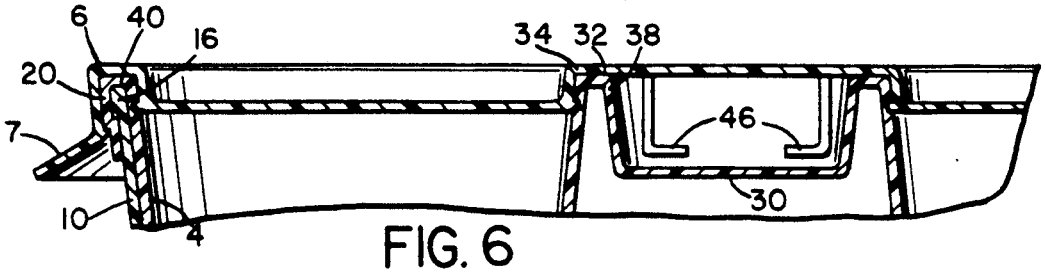
FIG. 6 is an enlarged sectional view, taken on line 6—6 of FIG. 3, showing the lid in a closed position.

It is preferred that there be an interior groove 42 along the upper portion of the inner surface of wall 30 of each container 26 and a corresponding protruding rib 44 at the outer edge of each recess 32, such that when cover 6 is sealingly engaged with tray 4, the ribs 44 are seated in grooves 42 to provide additional locking and sealing function, as indicated in FIG. 5.

Lip 7, which flares outwardly from the body of cover 6, may be provided if desired. The function of lip 7 is to provide a gripping surface for the user's fingers for ease of unsealing and opening the container. If the embodiment shown lip 7 completely encircles the cover 6, but it may also be formed as discontinuous sections. A similar structure may be formed on the perimeter of tray 4 for the same purpose if desired.

The containers of the present invention can be made of any convenient material which has a sufficient combination of rigidity and flexibility to form a sturdy and stable container but which allows for the flexing and movement of the three components, such that they can be repeatedly engaged in a sealing configuration and disengaged for access to the contents, for cleaning or for filling. Conveniently the containers will be made of some sort of plastic or polymeric material such as a semi-rigid polyethylene or polypropylene, a hard rubber or the like. It is also contemplated that the container could be made of a flexible metal. Of course each of the individual components can be made of the same or a different material from the other components, as long as the different materials are such that they will sealingly engage with each other as described. Thus, for instance, one could have a container 1 with a metal base 2 while the tray 4 and cover 6 are made of a plastic material. Other combinations and other suitable materials will readily suggest themselves to those skilled in the art.

One preferred utilization of the container is as a kit for sandwich making. To this end each of the compartments will be suitable for the storage of foodstuffs, including providing space for bread, meat, lettuce, tomatoes, condiments and the like, with each item being fully segregated from the others. One can also use the container for the storage of other types of meal components, such as having the container hold the various components of different types of salads. Several courses of a meal could also be contained by the present device, with one container holding a salad, another the main dish, a third the dessert and so forth. In this regard I have also contemplated that the cover or tray may have included therein brackets 46 to secure eating utensils.

Alternatively, one could use the container to segregate a wide variety of different items which are not susceptible to being contained in conventional containers such as tackle boxes or sewing boxes, as where contact between various items could damage or destroy some of the items. For instance, one could segregate dry materials from liquids or segregate caustic or acidic materials from other materials which would be damaged by contact with the caustic or acids. Thus, a container of the present type could be quite advantageously used as a chemical test kit, where the various different types of reagents needed by the technician are safely segregated into different containers.

Similarly, one could use the container of the present invention to isolate and segregate different types of medications so that the patient/user would not be in danger of having medications inadvertently mixed, or of having a powdered or tableted medication become contaminated by contact with a liquid medication.

Other uses will readily suggest themselves to those skilled in the art, and it is intended that all such uses are to be considered as included in the present invention.

The containers of the present invention can be manufactured in any convenient size. Obviously the size should be sufficiently large that the individual compartments 26 are of useful size for containing the desired materials or items. It is also desirable that the container 1 be small enough to be readily portable, even when filled with foodstuffs or other items. To this end, handles 48 may be attached to the outside of base 2 as shown in FIG. 3 so that larger sized containers can be more readily carried. Sizes of the containers of this invention will generally correspond to sizes of typical commercial portable coolers that are commonly sold for household, sports, travel and similar activities. These dimensions are typically 12–48 inches (30–120 cm) in length, 8–24 inches (20–60 cm) in breadth and 6–18 inches (15–45 cm) in depth, although these ranges are intended to be general and not to define precise limiting dimensions.

It will be evident from the description above that there are numerous embodiments of the present invention which, while not expressly described above, are clearly within the scope and spirit of the invention. Consequently, the above description is intended to be exemplary only and the scope of the invention is to be defined solely by the appended claims.

I claim:

1. A resealable compartmented container for foodstuffs and the like comprising:

an open-topped base having a bottom and sides, said base having an open interior volume;

a tray having a plurality of open-topped compartments therein, each said compartment having a bottom and sides and having an open interior volume, said tray also having peripheral sides; and a cover;

said peripheral sides of said tray including support means engagable with the top of said sides of said base to support said tray in a position overlying the open top of said base;

said walls of said compartments and said peripheral sides of said tray being aligned and forming a grid-like pattern; and said cover including releasable closure means directed downwardly therefrom, forming a mirror-image of said grid-like pattern of said tray and being sealably engagable with said top edges of said walls and said sides throughout said grid-like pattern to form a substantially air-tight releasable seal with each said compartment when said tray is disposed overlying said base and said cover is removably secured to said tray.

2. A container as in claim 1 wherein said compartments project into said open interior volume of said base when said tray is disposed in overlying position on said base.

3. A container as in claim 2 wherein said open interior volume of said base is of greater size than is required to accommodate said compartments.

4. A container as in claim 3 wherein the excess volume over that required to accommodate said compartments is adapted to contain cooling means for said container.

5. A container as in claim 1 wherein said plurality of compartments includes compartments of different volumes from one another.

6. A container as in claim 5 wherein said different volumes are obtained by said compartments having different depths, widths, breadths or combinations thereof.

7. A container as in claim 1 wherein said closure means of said cover comprises a plurality of recesses which are engagable in gripping configuration with the top portions of said walls and sides of said tray to form continuous seals along the top portions of said wells when said cover is positioned on said tray.

8. A container as in claim 7 wherein said recesses are formed by U-shaped channels on the under surface of said cover.

9. A container as in claim 8 wherein said channels are formed in the body of said cover.

10. A container as in claim 8 wherein said channels project outwardly from the under surface of said cover.

11. A container as in claim 7 wherein said channels also contain ribs disposed at the outer edge thereof and are adapted to be are seated in corresponding grooves in said walls and sides of said compartments when said cover is sealingly engaged with said tray.

12. A container as in claim 1 being formed of a plastic, polymeric resin or metal material.

13. A container as in claim 12 wherein said material is a polyethylene or polypropylene.

* * * * *

UNITED STATES PATENT AND TRADEMARK OFFICE

CERTIFICATE OF CORRECTION

PATENT NO. : 5,027,972

DATED : July 2, 1991

INVENTOR(S) : Robert B. Bartholomew

It is certified that error appears in the above-identified patent and that said Letters Patent is hereby corrected as shown below:

Column 6, Line 62, delete "wells" insert --walls--

Signed and Sealed this

Ninth Day of November, 1993

Bruce Lehman

*Attest:*

BRUCE LEHMAN

*Attesting Officer*

*Commissioner of Patents and Trademarks*